US005498926A

United States Patent [19]

Kyushima et al.

[11] Patent Number: 5,498,926

[45] Date of Patent: Mar. 12, 1996

[54] ELECTRON MULTIPLIER FOR FORMING A PHOTOMULTIPLIER AND CASCADE MULTIPLYING AN INCIDENT ELECTRON FLOW USING MULTILAYERD DYNODES

[75] Inventors: Hiroyuki Kyushima; Koji Nagura; Yutaka Hasegawa; Eiichiro Kawano; Tomihiko Kuroyanagi; Akira Atsumi; Masuya Mizuide, all of Hamamatsu, Japan

[73] Assignee: Hamamatsu Photonics K.K., Hamamatsu, Japan

[21] Appl. No.: 234,142

[22] Filed: Apr. 28, 1994

[30] Foreign Application Priority Data

Apr. 28, 1993 [JP] Japan ..... 5-102898

[51] Int. Cl.[6] ..... H01J 43/22; H01J 43/04

[52] U.S. Cl. ..... 313/533; 313/532; 313/103 CM; 313/105 CM

[58] Field of Search ..... 313/532, 533, 313/534, 535, 536, 537, 540, 541, 542, 544, 103 R, 103 CM, 105 R, 105 CM, 49, 51; 250/214 VT

[56] References Cited

U.S. PATENT DOCUMENTS 4,577,137 3/1986 Kaiser .
4,649,314 3/1987 Eschard .
4,963,113 10/1990 Muramatsu .
4,998,037 3/1991 Kerkhof et al. .
4,999,540 3/1991 L'hermite ..... 313/103 CM

FOREIGN PATENT DOCUMENTS 0078078 5/1983 European Pat. Off. .
3925776 3/1990 Germany .
59-151741 8/1984 Japan .
60-39752 3/1985 Japan .
246646 2/1990 Japan .
3254058 11/1991 Japan .
1405256 9/1975 United Kingdom .

*Primary Examiner*—Donald J. Yusko
*Assistant Examiner*—N. D. Patel
*Attorney, Agent, or Firm*—Cushman Darby & Cushman

[57] ABSTRACT

A photomultiplier which can be easily made compact has a dynode unit constituted by stacking a plurality of stages of dynode plates in an electron incident direction in a vacuum container constituted by a housing and a base member integrally formed with the housing. Each dynode plate has an engaging member engaged with a connecting pin for applying a voltage at a side surface thereof. Through holes for guiding the connecting pins from the outside of the container are formed in the base member. Each engaging member is arranged not to overlap the remaining engaging members in the stacking direction of the dynode plates. The arrangement position of each engaging member and the arrangement position of the through hole for guiding the corresponding connecting pin to be connected are matched with each other.

51 Claims, 7 Drawing Sheets

ELECTRON MULTIPLIER FOR FORMING A PHOTOMULTIPLIER AND CASCADE MULTIPLYING AN INCIDENT ELECTRON FLOW USING MULTILAYERD DYNODES

BACKGROUND OF THE INVENTION

1. Field of the Invention

The present invention relates to a photomultiplier and, more particularly, to an electron multiplier for constituting the photomultiplier and cascade-multiplying an incident electron flow by multilayered dynodes.

2. Related Background Art

A conventional electron multiplier constitutes a photomultiplier having a photocathode. This electron multiplier is constituted by anodes and a dynode unit constituted by stacking a plurality of stages of dynodes in the incident direction of an electron flow in a vacuum container. Each dynode has a connecting portion for applying a predetermined voltage. The connecting portion and a stem pin connected to an external power supply terminal are electrically connected by a wiring member, thereby realizing the structure for applying a voltage to each dynode.

SUMMARY OF THE INVENTION

A photomultiplier of the present invention is formed in consideration of the arrangement positions of a connecting terminal for applying a voltage to each dynode plate and a connecting pin (corresponding to the stem pin) for applying a voltage from an external power supply. Therefore, it is unnecessary to use a wiring member whose length or shape can be freely changed, or three-dimensionally form the wiring member.

The engaging member is constituted by a pair of guide pieces for directly guiding the connecting pin. Therefore, even when the wiring member is connected, it is unnecessary to bend the end portion of this wiring member to reach the position where the engaging member is provided.

On the other hand, conventionally, when the wiring member is used, one end of this wiring member and the stem pin, and the other end of the wiring member and the connecting portion must be resistance-welded, respectively. This is a factor for decreasing the operation efficiency of assembling. As the photomultipliers to be manufactured become compact, this decrease in the operation efficiency becomes more conspicuous. Since the welding operation requires skills, the operation efficiency of assembling is further decreased.

As described above, it is one of objects of the present invention to provide a photomultiplier having a structure which can facilitate the manufacture of even a compact photomultiplier.

The present invention has a structure effective also in this situation.

A photomultiplier according to the present invention comprises a photocathode and an electron multiplier including anodes and a dynode unit arranged between the anodes and the photocathode.

The electron multiplier is mounted on a base member and arranged in a housing formed integral with the base member for fabricating a vacuum container. The photocathode is arranged inside the housing and deposited on the surface of a light receiving plate provided to the housing. At least one anode is supported by an anode plate and arranged between the dynode unit and the base member. The dynode unit is constituted by stacking a plurality of stages of dynode plates for respectively supporting at least one dynode for receiving and cascade-multiplying photoelectrons emitted from the photocathode in an incidence direction of the photoelectrons.

The housing may have an inner wall thereof deposited a conductive metal for applying a predetermined voltage to the photocathode and rendered conductive by a predetermined conductive metal to equalize the potentials of the housing and the photocathode.

The photomultiplier according to the present invention has at least one focusing electrode between the dynode unit and the photocathode. The focusing electrode is supported by a focusing electrode plate. The focusing electrode plate is fixed on the electron incident side of the dynode unit through insulating members. The focusing electrode plate has holding springs and at least one contact terminal, all of which are integrally formed with this plate. The holding springs are in contact with the inner wall of the housing to hold the arrangement position of the dynode unit fixed on the focusing electrode plate through the insulating members. The contact terminal is in contact with the photocathode to equalize the potentials of the focusing electrodes and the photocathode. The contact terminal functions as a spring.

A plurality of anodes may be provided to the anode plate, and electron passage holes through which secondary electrons pass are formed in the anode plate in correspondence with positions where the secondary electrons emitted from the last-stage of the dynode unit reach. Therefore, the photomultiplier has, between the anode plate and the base member, an inverting dynode plate for supporting at least one inverting dynode parallel to the anode plate. The inverting dynode plate inverts the orbits of the secondary electrons passing through the anode plate toward the anodes. The diameter of the electron incident port (dynode unit side) of the electron passage hole formed in the anode plate is smaller than that of the electron exit port (inverting dynode plate side). The inverting dynode plate has, at positions opposing the anodes, a plurality of through holes for injecting a metal vapor to form a secondary electron emitting layer on the surface of each dynode of the dynode unit.

On the other hand, the photomultiplier according to the present invention may have, between the inverting dynode plate and the base member, a shield electrode plate for supporting at least one shield electrode parallel to the inverting dynode plate. The shield electrode plate inverts the orbits of the secondary electrons passing through the anode plate toward the anodes. The shield electrode plate has a plurality of through holes for injecting a metal vapor to form at least a secondary electron emitting layer on the surface of each dynode of the dynode unit. In place of this shield electrode plate, a surface portion of the base member opposing the anode plate may be used as an electrode and substituted for the shield electrode plate.

In particular, the electron multiplier comprises a dynode unit constituted by stacking a plurality of stages of dynode plates, the dynode plates spaced apart from each other at predetermined intervals through insulating members in an incidence direction of the electron flow, for respectively supporting at least one dynode for cascade-multiplying an incident electron flow, and an anode plate opposing the last-stage dynode plate of the dynode unit through insulating members. Each dynode plate has a first concave portion for arranging a first insulating member which is provided on the first main surface of the dynode plate and partially in contact with the first concave portion and a second concave portion for arranging a second insulating member which is provided on the second main surface of the dynode plate and partially in contact with the second concave portion (the second concave portion communicates with the first concave portion through a through hole). The first insulating member arranged on the first concave portion and the second insulating member arranged on the second concave portion are in contact with each other in the through hole. An interval between the contact portion between the first concave portion and the first insulating member and the contact portion between the second concave portion and the second insulating member is smaller than that between the first and second main surfaces of the dynode plate. The concave portion can be provided in the anode plate, the focusing plate, the inverting electrode plate and the shield electrode plate.

Important points to be noted in the above structure will be listed below. The first point is that gaps are formed between the surface of the first insulating member and the main surface of the first concave portion and between the second insulating member and the main surface of the second concave portion, respectively, to prevent discharge between the dynode plates. The second point is that the central point of the first insulating member, the central point of the second insulating member, and the contact point between the first and second insulating members are aligned on the same line in the stacking direction of the dynode plates so that the intervals between the dynode plates can be sufficiently maintained.

Using spherical or circularly cylindrical bodies as the first and second insulating members, the photomultiplier can be easily manufactured. When circularly cylindrical bodies are used, the outer surfaces of these bodies are brought into contact with each other. The shape of an insulating member is not limited to this. For example, an insulating member having an elliptical or polygonal section can also be used as long as the object of the present invention can be achieved.

In this electron multiplier, each dynode plate has an engaging member at a predetermined position of a side surface of the plate to engage with a corresponding connecting pin for applying a predetermined voltage. Therefore, the engaging member is projecting in a vertical direction to the incident direction of the photoelectrons. The engaging member is constituted by a pair of guide pieces for guiding the connecting pin. On the other hand, a portion near the end portion of the connecting pin, which is brought into contact with the engaging member, may be formed of a metal material having a rigidity lower than that of the remaining portion.

Each dynode plate has an engaging member adapted to engage with a corresponding one of the connecting pins and projecting from a predetermined portion of a side surface thereof in parallel to the incident direction of said photoelectrons. The predetermined portion of the dynode plates adjacent to each other do not cause the engaging members to overlap each other in the stacking direction of the dynode plates. The arrangement position of the engaging member provided to the side surface of each dynode plate and the arrangement position of a through hole formed in the base member to guide the connecting pin for individually applying a voltage to the desired dynode plate are matched with each other in the stacking direction of the dynode plates. As described above, the engaging member provided to the side surface of each dynode plate and the through hole of the connecting pin corresponding to this engaging member are matched with each other at their arrangement positions in the stacking direction of the dynode unit. Therefore, the connecting pin is not bent to reach a desired connecting portion, or indirectly connected through another wiring member. That is, these complicated steps in manufacturing the photomultiplier become unnecessary, thereby providing a structure in which a voltage is applied by a connecting pin having a minimum length for each dynode plate.

In addition, the connecting pin guided to the base member is fixed at a predetermined portion to the base member by a fixing member consisting of a glass material. The fixing member has a shape tapered from the surface of the base member along the connecting pin. This is because the breakdown voltage or leakage current of this fixing portion is taken into consideration.

Each dynode plate is constituted by at least two plates, each having at least one opening for forming as the dynode and integrally formed by welding such that the openings are matched with each other to function as the dynode when the two plates are overlapped. To integrally form these two plates by welding, each of the plates has at least one projecting piece for welding the corresponding two plates. The side surface of the plate is located in parallel with respect to the incident direction of the photoelectrons.

The engaging member is provided to each dynode plate at the position of the corresponding connecting pin in advance. Therefore, at the time of assembly, the position of the engaging member of each dynode plate and the position of the corresponding connecting pin are matched with each other in the stacking direction of the dynode plates. A pair of guide pieces for constituting the engaging member can be connected to the corresponding connecting pin at this portion by resistance-welding or the like.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

An embodiment of the present invention will be described below with reference to FIGS. 1 to 13.

Figure 1:
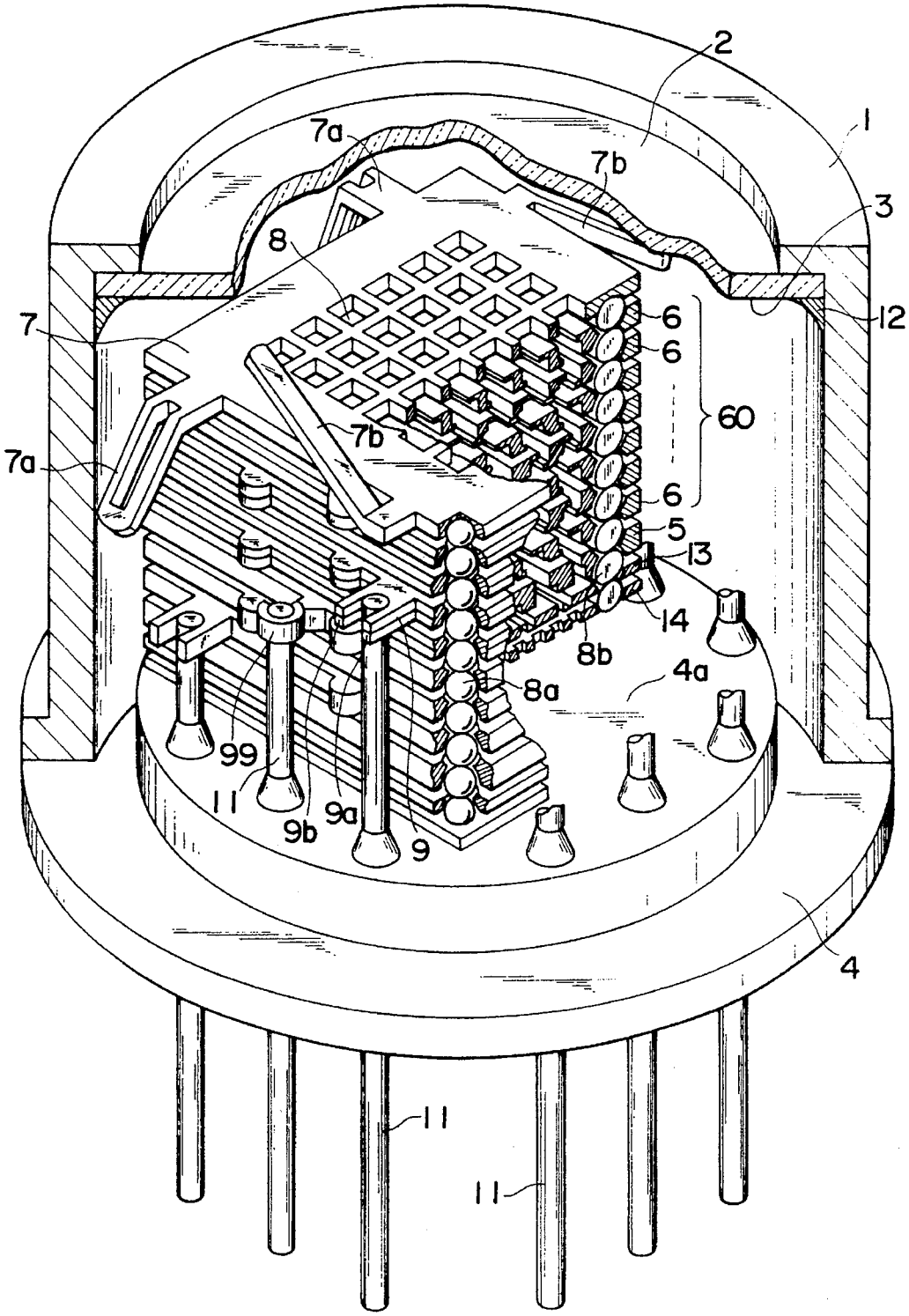
FIG. 1 is a partially cutaway sectional view showing the entire structure of a photomultiplier according to the present invention.

FIG. 1 is a perspective view showing the entire structure of a photomultiplier according to the present invention. Referring to FIG. 1, the photomultiplier is basically constituted by a photocathode 3 and an electron multiplier. The electron multiplier includes anodes (anode plate 5) and a dynode unit 60 arranged between the photocathode 3 and the anodes.

The electron multiplier is mounted on a base member 4 and arranged in a housing 1 which is formed integral with the base member 4 to fabricate a vacuum container. The photocathode 3 is arranged inside the housing 1 and deposited on the surface of a light receiving plate 2 provided to the housing 1. The anodes are supported by the anode plate 5 and arranged between the dynode unit 60 and the base member 4. The dynode unit 60 is formed by stacking a plurality of stages of dynode plates 6, for respectively supporting a plurality of dynodes 603 (FIG. 2) for receiving and cascade-multiplying photoelectrons emitted from the photocathode 3, in the incidence direction of the photoelectrons.

The photomultiplier also has focusing electrodes 8 between the dynode unit 60 and the photocathode 3 for correcting orbits of the photoelectrons emitted from the photocathode 3. These focusing electrodes 8 are supported by a focusing electrode plate 7. The focusing electrode plate 7 is fixed on the electron incidence side of the dynode unit 60 through insulating members **8*a* and 8*b*. The focusing electrode plate 7 has holding springs 7*a* and contact terminals 7*b*, all of which are integrally formed with this plate 7. The holding springs 7*a* are in contact with the inner wall of the housing 1 to hold the arrangement position of the dynode unit 60 fixed on the focusing electrode plate 7 through the insulating members 8*a* and 8*b*. The contact terminals 7*b* are in contact with the photocathode 3 to equalize the potentials of the focusing electrodes 8 and the photocathode 3 and functions as springs. When the focusing electrode plate 7 has no contact terminal 7*b*, the housing 1 may have on an inner wall thereof deposited a conductive metal for applying a predetermined voltage to the photocathode 3, and the contact portion between the housing 1 and the photocathode 3 may be rendered conductive by a predetermined conductive metal 12 to equalize the potentials of the housing 1 and the photocathode 3. Although both the contact terminals 7*b* and the conductive metal 12 are illustrated in FIG. 1**, one structure can be selected and realized in actual implementation.

The anode is supported by the anode plate 5. A plurality of anodes may be provided to this anode plate 5, and electron passage holes through which secondary electrons pass are formed in the anode plate 5 in correspondence with positions where the secondary electrons emitted from the last-stage dynode plate of the dynode unit 60 reach. Therefore, this photomultiplier has, between the anode plate 5 and the base member 4, an inverting dynode plate 13 for supporting inverting dynodes in parallel to the anode plate 5. The inverting dynode plate 13 inverts the orbits of the secondary electrons passing through the anode plate 5 toward the anodes. The diameter of the electron incident port (dynode unit 60 side) of the electron passage hole formed in the anode plate 5 is smaller than that of the electron exit port (inverting dynode plate 13 side). The inverting dynode plate 13 has, at positions opposing the anodes, a plurality of through holes for injecting a metal vapor to form a secondary electron emitting layer on the surface of each dynode 603 of the dynode unit 60.

On the other hand, the photomultiplier may have, between the inverting dynode plate 13 and the base member 4, a shield electrode plate 14 for supporting sealed electrodes in parallel to the inverting dynode plate 13. The shield electrode plate 14 inverts the orbits of the secondary electrons passing through the anode plate 5 toward the anodes. The shield electrode plate 14 has a plurality of through holes for injecting a metal vapor to form a secondary electron emitting layer on the surface of each dynode 603 of the dynode unit 60. In place of this shield electrode plate 14, a surface portion **4*a* of the base member 4 opposing the anode plate 5 may be used as a sealed electrode and substituted for the shield electrode plate 14**.

In particular, the electron multiplier comprises a dynode unit 60 constituted by stacking a plurality of stages of dynode plates 6, spaced apart from each other at predetermined intervals by the insulating members **8*a* and 8*b* in the incidence direction of the electron flow, and each dynode plate 6 is supporting a plurality of dynodes 603 for cascade-multiplying an incident electron flow, and the anode plate 5 opposing the last-stage dynode plate 6 of the dynode unit 60 through the insulating members 8*a* and 8*b***.

In this electron multiplier, each dynode plate 6 has an engaging member 9 at a predetermined position of a side surface of the plate to engage with a corresponding connecting pin 11 for applying a predetermined voltage. The side surface of the dynode plate 6 is parallel with respect to the incident direction of the photoelectrons. The engaging member 9 is made of a pair of guide pieces **9*a* and 9*b* for guiding the connecting pin 11. The engaging member may have a hook-like structure (engaging member 99 illustrated in FIG. 2). The shape of this engaging member is not particularly limited as long as the connecting pin 11 is received and engaged with the engaging member. On the other hand, a portion near the end portion of the connecting pin 11, which is brought into contact with the engaging member 9**, may be formed of a metal material having a rigidity lower than that of the remaining portion.

The engaging members 9 and 99 are respectively arranged in the side surface of the dynode plates 6 not to overlap each other in the stacking direction of the dynode plates. Through holes for guiding the connecting pins 11 are formed in a base member 4 to surround a region where the dynode unit 60 is mounted. The arrangement position of each of the engaging members 9 and 99 and the arrangement position of the corresponding through hole are matched with each other in the stacking direction of the dynode unit 60. In other words, the distal end portion of each connecting pin 11 can be inserted into the vacuum vessel by only a minimum necessary length (see FIGS. 1 and 9). Therefore, the connecting pin 11 is not bent to reach a desired connecting portion, or indirectly connected through another wiring member. These complicated steps in manufacturing the photomultiplier become unnecessary, thereby providing a structure in which a voltage is applied by a connecting pin having a minimum length for each dynode plate 6.

In addition, the connecting pin 11 guided to the base member 4 is fixed to the base portion 4 at a predetermined portion by a fixing member 15 (see FIG. 9) consisting of a glass material. The fixing member 15 has a shape tapered from the surface of the base member 4 along the connecting pin 11. This is because the breakdown voltage or leakage current of this fixing portion is taken into consideration.

Each dynode plate 6 used is constituted by two plates 6*a* and 6*b* having openings for forming the dynodes and integrally formed by welding such that the openings are matched with each other to function as dynodes when the two plate overlap each other. To integrally form the two plates 6*a* and 6*b* by welding, the two plates 6*a* and 6*b* have projecting pieces 10 for welding the corresponding projecting pieces thereof at predetermined positions matching when the two plates 6*a* and 6*b* are overlap each other.

Figure 2:
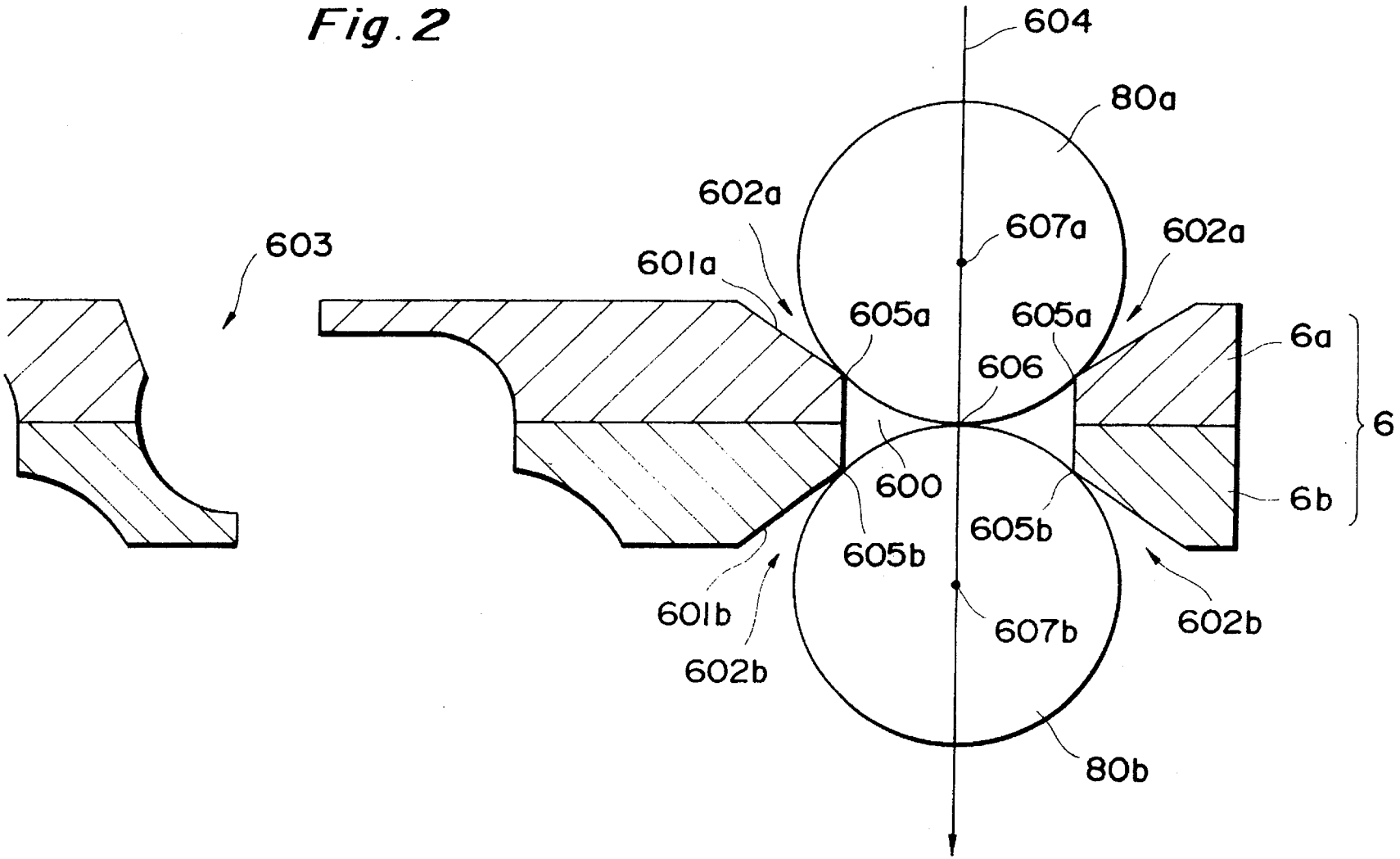
FIG. 2 is a sectional view showing a typical shape of a concave portion formed in a dynode plate in the photomultiplier according to the present invention.

The structure of each dynode plate 6 for constituting the dynode unit 60 will be described below. FIG. 2 is a sectional view showing the shape of the dynode plate 6. Referring to FIG. 2, the dynode plate 6 has a first concave portion 601*a* for arranging a first insulating member 80*a* which is provided on a first main surface of the dynode plate 6 and partially in contact with the first concave portion 601*a* and a second concave portion 601*b* for arranging a second insulating member 80*b* which is provided on a second main surface of the dynode plate 6 and partially in contact with the second concave portion 601*b* (the second concave portion 601*b* communicates with the first concave portion 601 through a through hole 600). The first insulating member 80*a* arranged on the first concave portion 601*a* and the second insulating member 80*b* arranged on the second concave portion 601*b* are in contact with each other in the through hole 600. An interval between the contact portion 605*a* between the first concave portion 601*a* and the first insulating member 80*a* and the contact portion 605*b* of the second concave portion 601*b* and the second insulating member 80*b* is smaller than that (thickness of the dynode plate 6) between the first and second main surfaces of the dynode plate 6.

Gaps 602*a* and 602*b* are formed between the surface of the first insulating member 80*a* and the main surface of the first concave portion 601*a* and between the second insulating member 80*b* and the main surface of the second concave portion 601*b*, respectively, to prevent discharge between the dynode plates 6. A central point 607*a* of the first insulating member 80*a*, a central point 607*b* of the second insulating member 80*b*, and a contact point 606 between the first and second insulating members 80*a* and 80*b* are aligned on the same line 604 in the stacking direction of the dynode plates 6 so that the intervals between the dynode plates 6 can be sufficiently kept.

Using the spherical bodies 8*a* or circularly cylindrical bodies 8*b* as the first and second insulating members 80*a* and 80*b* (insulating members 8*a* and 8*b* in FIG. 1), the photomultiplier can be easily manufactured. When circularly cylindrical bodies are used, the side surfaces of the circularly cylindrical bodies are brought into contact with each other. The shape of the insulating member is not limited to this. For example, an insulating member having an elliptical or polygonal section can also be used as long as the object of the present invention can be achieved. Referring to FIG. 2, reference numeral 603 denotes a dynode. A secondary electron emitting layer containing an alkali metal is formed on the surface of this dynode.

The shapes of the concave portion will be described below with reference to FIGS. 3 to 6. For the sake of descriptive convenience, only the first main surface of the dynode plate 6 is disclosed in FIGS. 3 to 6.

Figure 3:
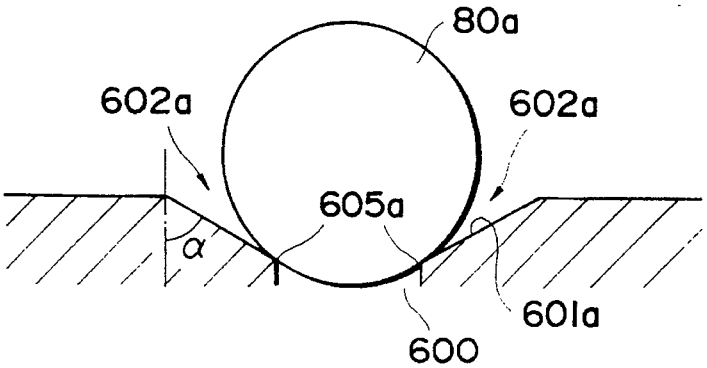
FIG. 3 is a sectional view showing the first shape of the concave portion as a first application of the concave portion shown in FIG. 2.

The first concave portion 601*a* is generally formed of a surface having a predetermined taper angle ($\alpha$) with respect to the direction of thickness of the dynode plate 6, as shown in FIG. 3.

Figure 4:
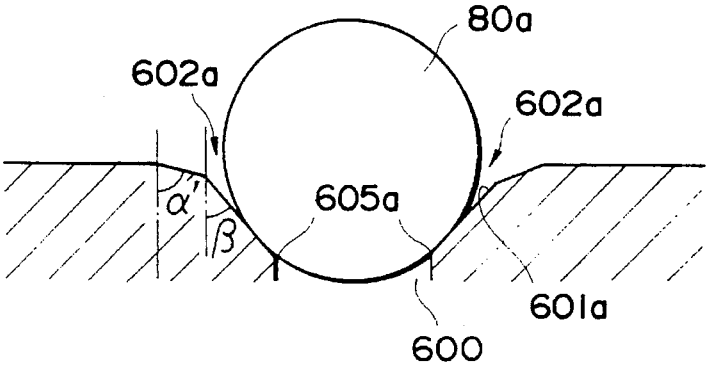
FIG. 4 is a sectional view showing the second shape of the concave portion as a second application of the concave portion shown in FIG. 2.

This first concave portion 601*a* may include a plurality of surfaces having predetermined taper angles ($\alpha$ and $\beta$) with respect to the direction of thickness of the dynode plate 6, as shown in FIG. 4.

Figure 5:
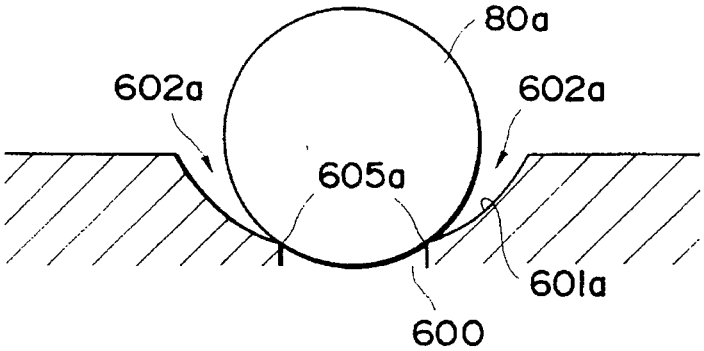
FIG. 5 is a sectional view showing the third shape of the concave portion as a third application of the concave portion shown in FIG. 2.

The surface of the first concave portion 601*a* may be a curved surface having a predetermined curvature, as shown in FIG. 5. The curvature of the surface of the first concave portion 601*a* is set smaller than that of the first insulating member 80*a*, thereby forming the gap 602*a* between the surface of the first concave portion 601*a* and the surface of the first insulating member 80*a*.

Figure 6:
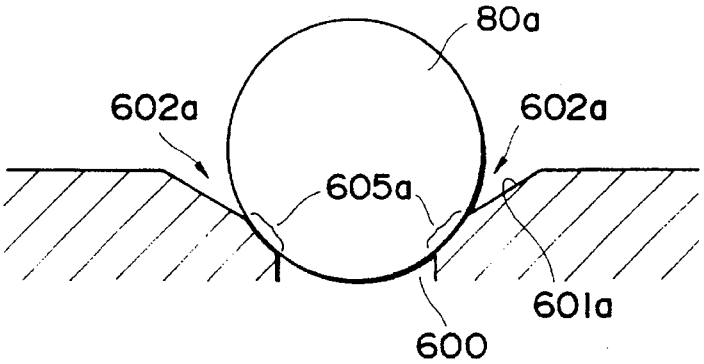
FIG. 6 is a sectional view showing the fourth shape of the concave portion as a fourth application of the concave portion shown in FIG. 2.

To obtain a stable contact state with respect to the first insulating member 80*a*, a surface to be brought into contact with the first insulating member 80*a* may be provided to the first concave portion 601*a*, as shown in FIG. 6. In this embodiment, a structure having a high mechanical strength against a pressure in the direction of thickness of the dynode plate 6 even compared to the above-described structures in FIGS. 3 to 5 can be obtained.

Figure 7:
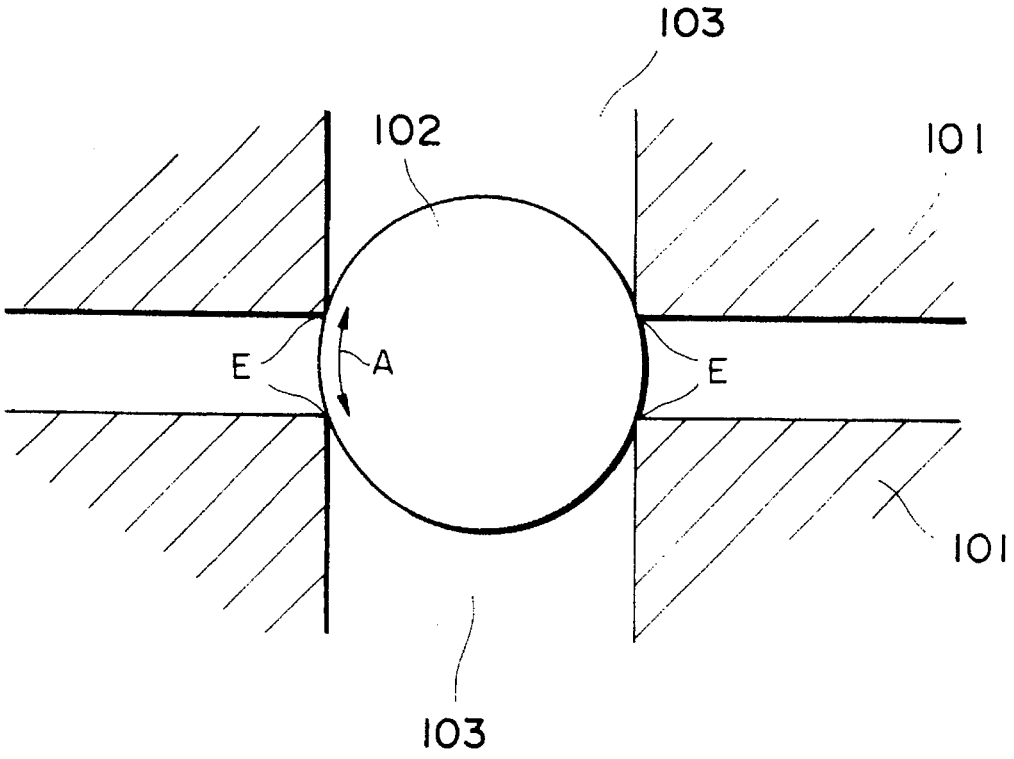
FIG. 7 is a sectional view showing the structure of a comparative example for explaining the effect of the present invention.
Figure 8:
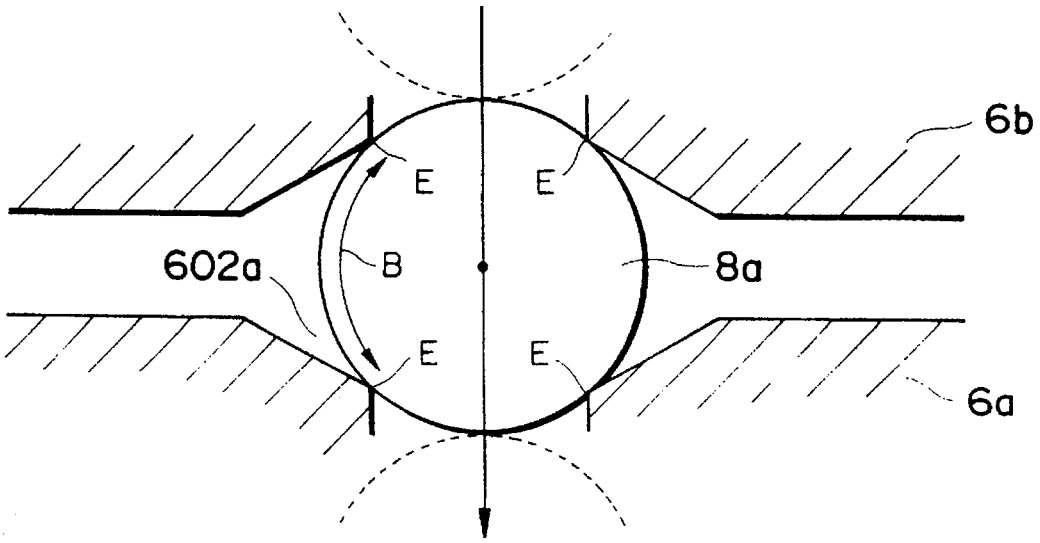
FIG. 8 is a sectional view showing the structure between dynode plates, for explaining the effect of the present invention.

The detailed structure between the dynode plates 6, adjacent to each other, of the dynode unit 60 will be described below with reference to FIGS. 7 and 8. FIG. 7 is a partial sectional view showing the conventional photomultiplier as a comparative example of the present invention. FIG. 8 is a partial sectional view showing the photomultiplier according to an embodiment of the present invention.

In the comparative example shown in FIG. 8, the interval between the support plates 101 having no concave portion is almost the same as a distance A (between contact portions E between the support plates 101 and the insulating member 102) along the surface of the insulating member 102.

Figure 9:
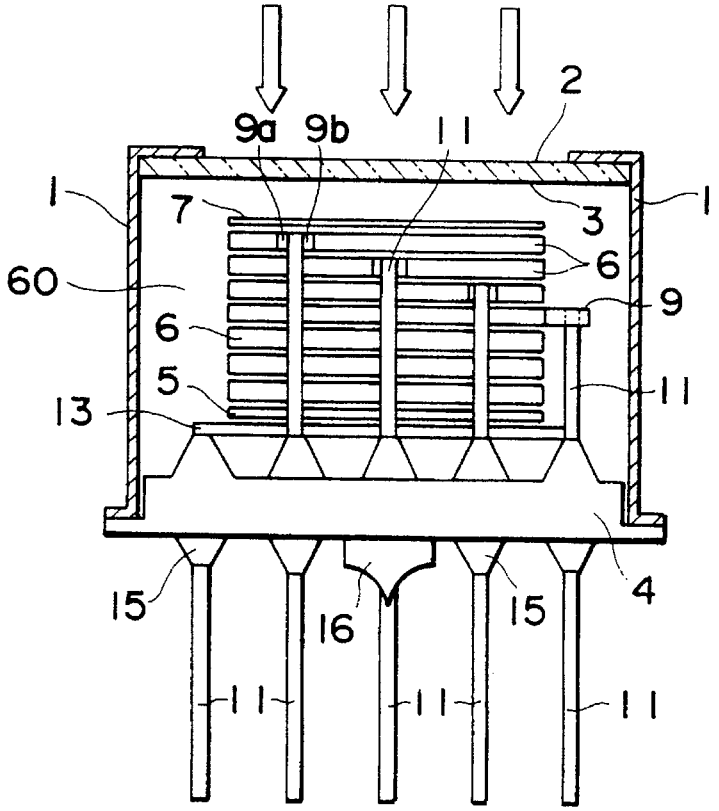
FIG. 9 is a sectional side view showing the simple internal structure of the photomultiplier, in which a metal housing 3 in the photomultiplier according to the present invention is cut.

On the other hand, in an embodiment of the present invention shown in FIG. 9, since concave portions are formed, a distance B (between the contact portions E between the plates 6*a* and 6*b* and the insulating member 8*a*) along the surface of the insulating member 8*a* is larger than the interval between plates 6*a* and 6*b*. Generally, discharge between the plates 6*a* and 6*b* is assumed to be caused along the surface of the insulating member 102 or 8*a* due to dust or the like deposited on the surface of the insulating member 102 or 8*a*. Therefore, as shown in this embodiment (see FIG. 8), when the concave portions are formed, the distance B along the surface of the insulating member 8*a* substantially increases as compared to the interval between the plates 6*a* and 6*b*, thereby preventing discharge which occurs when the insulating member 8*a* is inserted between the plates 6*a* and 6*b*.

The detailed structure of the photomultiplier will be described with reference to FIGS. 9 to 13.

Figure 10:
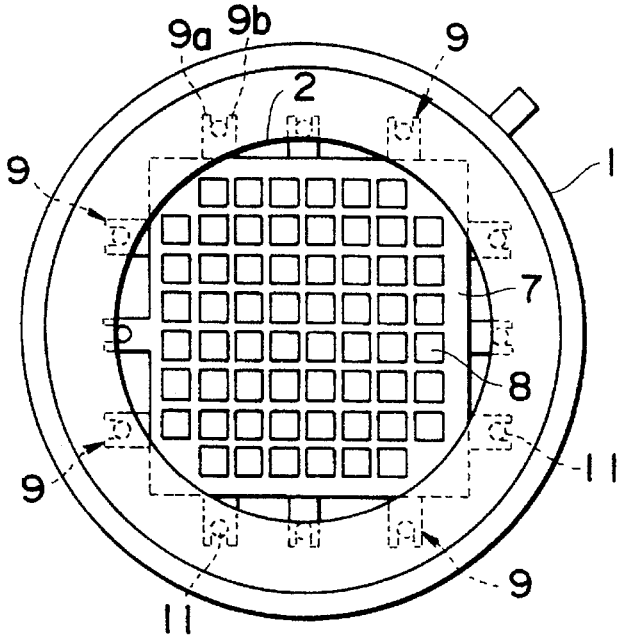
FIG. 10 is a plan view showing the photomultiplier according to the present invention shown in FIGS. 1 and 9.
Figure 11:
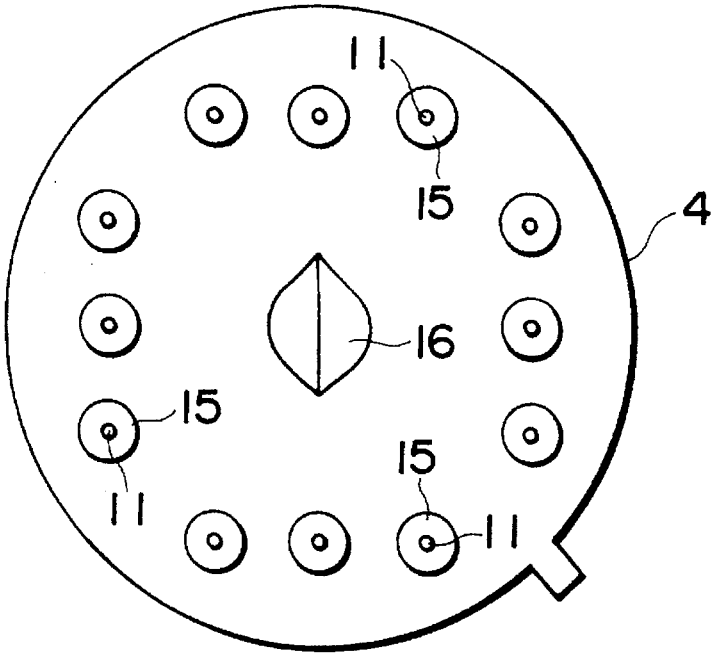
FIG. 11 is a plan view showing the bottom surface of the photomultiplier shown in FIG. 9.

A photomultiplier according to this embodiment is shown in FIGS. 9 to 11. In this photomultiplier, a vacuum container is formed of a circular light receiving plate 2 for receiving incident light, a cylindrical metal tube (housing) 1 disposed along the circumference of the light receiving plate 2, and the circular stem 4 making up the base member. An electron multiplier for cascade-multiplying an incident electron flow is disposed in this vacuum container.

This electron multiplier mainly comprises the dynode unit 60 formed by stacking a plurality of dynode plates 6 in the incident direction of the electrons, and an anode plate 5.

A photocathode 3 is provided on the lower surface of the light receiving plate 2. A focusing electrode plate 7 is disposed between the photocathode 3 and the dynode unit 60. Therefore, the electrons emitted from the photocathode 3 are focused by focusing electrodes 8 supported by the focusing electrode plate 7 and the electrons are incident on a predetermined region of the first-stage dynode plate 6 of the dynode unit 60.

The dynode unit 60 is formed by stacking a plurality of stages of dynode plates 6 shaped as square flat plates. A plurality of electron multiplication holes (dynodes) 603 are formed and arranged in a matrix in each dynode plate 6. The anode plate 5 and an inverting dynode plate 13 are sequentially disposed under the multilayered dynode plates 6 through insulating members.

The through holes for guiding the connecting pins 11 into the vacuum container are formed in the stem 4 to surround a region where the dynode unit 60 and the like (FIG. 11) are mounted. Reference numeral 15 denotes hermetic glass serving as fixing members for fixing the connecting pins 11.

Reference numeral 16 denotes a metal tip tube used to introduce an alkali metal vapor into the vacuum container or evacuate the vacuum container. After the metal tip tube 16 is used, its end portion is pressed and sealed.

Figure 12:
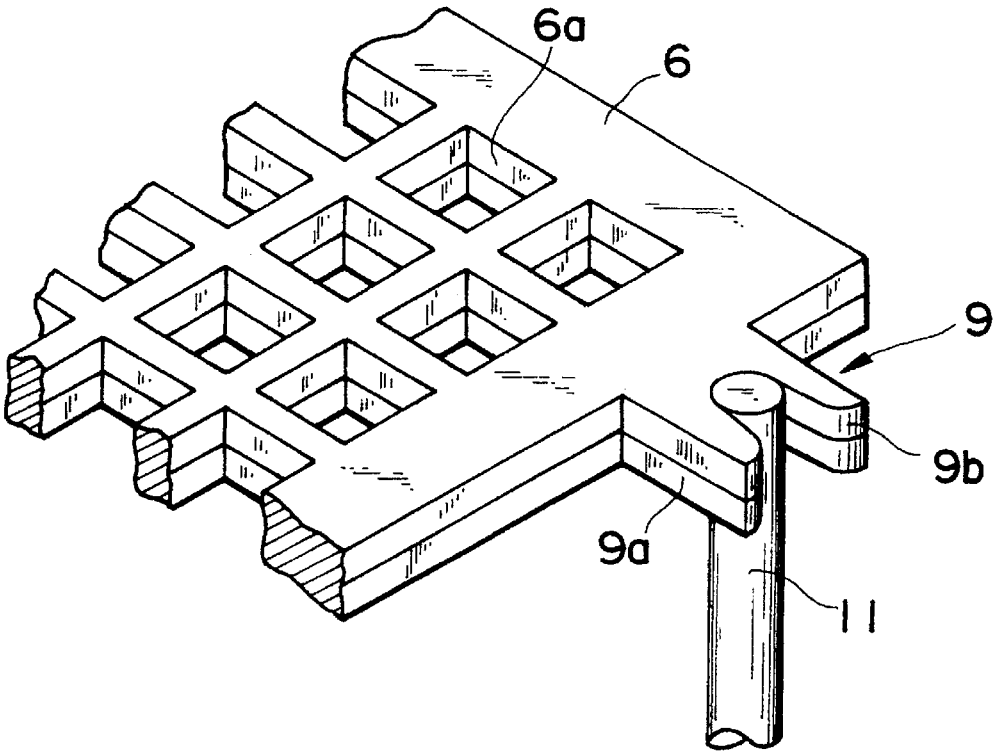
FIG. 12 is an enlarged view showing the first embodiment of an engaging member provided to each dynode plate.
Figure 13:
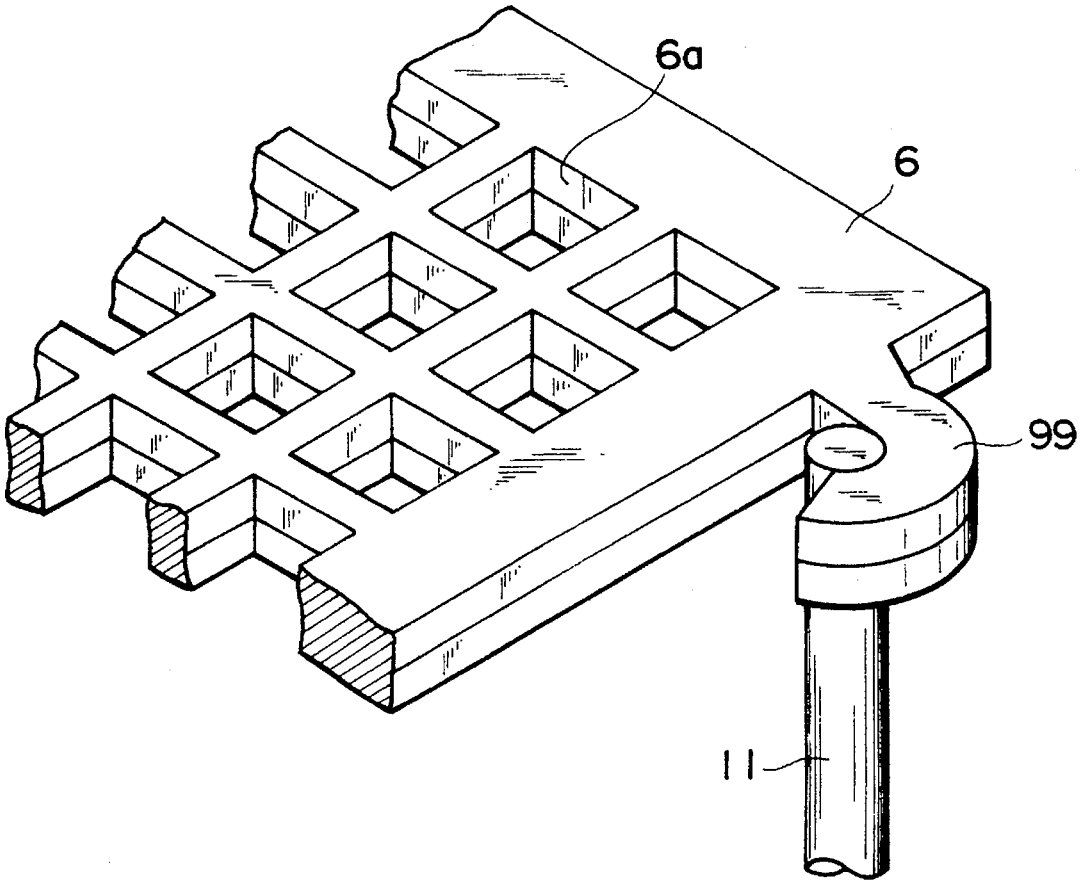
FIG. 13 is an enlarged view showing the second embodiment of an engaging member provided to each dynode plate.

As shown in the enlarged view of FIG. 12, a U-shaped engaging member 9 connected to the corresponding stem pin (connecting pin 11) to be described later is integrally formed with the side surface of each dynode plate 6. In the engaging member 9, a pair of guide pieces **9*a* and 9*b* project forward. A recessed portion between the two guide pieces has almost the same diameter as that of the stem pin 11. When the stem pin 11 is pushed into this recessed portion, the stem pin 11 is fit in the engaging member 9**.

Each engaging member 9 is disposed at the dynode plate 6 at a position corresponding to the predetermined stem pin 11. As shown in FIG. 10, three engaging members are provided along the corresponding side surfaces of the dynode plates 6 in correspondence with the arrangement positions of the stem pins 11 (to be described later).

The engaging members 9 are also provided to the above-described focusing electrode plate 7, the anode plate 5, the inverting dynode plate 13, and a shield electrode plate 14.

Twelve stem pins 11 connected to external voltage terminals to apply a predetermined voltage to the dynode plates 6, the anode plate 5 and the like extend through the stem 4 serving as the base member at predetermined positions. Three stem pins 11 are arranged along each side surface of the dynode unit 60 stacked in a cubic to surround the dynode unit 60. These stem pins 11 are fixed to the stem 4 by the tapered hermetic glass 15. Each stem pin 11 has a length to reach the corresponding engaging member 9 at its distal end portion. FIG. 9 shows a state in which the four dynode plates 6 from the top are connected to the corresponding four stem pins 11. In the stem pin 11, a portion near the portion corresponding to the engaging member 9 is formed of a relatively soft material such as copper. The remaining portion is formed of a relatively rigid material such as stainless steel. With this structure, the stem pin 11 is firmly fixed to the stem 4, and at the same time, when the stem pin 11 is fit in the engaging member 9, an excess stress applied to the stem 4 can be prevented. Since the distal end portion of the stem pin 11 is slightly inclined inward, the stem pin 11 can be easily fit in the engaging member 9. The stem pins 11 which are integrally formed of the same material can be sufficiently applied.

As shown in FIG. 11, the metal tip tube 16 having its end portion pressed and sealed projects from the center of the bottom portion of the stem 4. An alkali metal is introduced into the vacuum vessel or the vacuum vessel is evacuated through this metal tip tube 16, and thereafter, the metal tip tube 16 is sealed, as shown in FIG. 10.

When the dynode plates 6, the anode plate 5, and the like are stacked to assemble the photomultiplier, the position of the engaging member 9 of each dynode plate 6 or the like and the position of the corresponding stem pin 11 are matched with each other in a state in which the dynode plates 6 and the like are incorporated. As a result, each engaging member 9 can be directly connected to the corresponding stem pin 11 by resistance welding or the like so that this connecting operation can be easily performed. The engaging member 9 is not formed into the conventional flat shape but a U-shape with an open end. Therefore, the stem pin 11 is firmly fit in the engaging member 9, and the distal end portion of the stem pin 11 is not needed to be bent. After the stem pin 11 is fit in the recessed portion of the engaging member 9, the distal ends of the guide pieces **9*a* and 9*b* on both the sides can be pressed to hold the stem pin 11 inside the engaging member 9**. In this case, the subsequent welding operation can be facilitated.

In this embodiment, the engaging member 9 is formed into a U-shaped terminal. However, the shape of the engaging member 9 is not limited to this. For example, in addition to the shape shown in FIG. 13, a C-shaped (engaging member 99 shown in FIGS. 1 and 13), V-shaped, U-shaped or inverted V-shaped terminal can also be formed as long as the terminal can receive and be engaged with the stem pin 11.

In addition, in this embodiment, the stem pin 11 is fit in the recessed portion (between the guide pieces **9*a* and 9*b*) of the engaging member 9. However, the stem pin 11 need not be always fit in the engaging member 9 and can be sufficiently positioned inside the engaging member 9**.

Further, in this embodiment, the dynode plates 6 having the engaging members 9 are disposed in the photomultiplier having the photocathode 3. However, it can also be disposed in the electron multiplier, as a matter of course.

As has been described above, the photomultiplier according to the present invention has a plurality of connecting pins extending along the stacking direction of the dynode unit. The engaging member projects from the side surface of each dynode plate at the position corresponding to the connecting pin.

In the photomultiplier of the present invention, the position of each connecting pin and the position of the corresponding engaging member are matched with each other. Therefore, no conventional wiring member is needed. The connecting pins need not be bent. As a result, the connecting operation can be facilitated. Since resistance welding is required for only one engaging portion between each connecting pin and the corresponding engaging member, the operation efficiency of assembly can be improved. These effects are more remarkably provided when compact photomultipliers or electron multipliers are to be manufactured.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. An electron multiplier comprising:

an anode plate for supporting at least one anode;

a dynode unit provided in front of said anode plate through insulating members and formed by stacking a plurality of stages of dynode plates, spaced apart from each other at predetermined intervals through insulating members in an incident direction of electrons such that a last-stage dynode plate of said dynode unit opposes in parallel said anode plate, each dynode plate adapted to support at least one dynode for cascade-multiplying the incident electrons; and a plurality of connecting pins, each adapted to be connected to one of said dynode plates for applying a desired potential thereto, wherein each of said dynode plates having an engaging member adapted to be engaged with a corresponding one of said connecting pins and projecting from a predetermined portion of a side surface thereof in parallel to the incident direction of said electrons, and said predetermined portions of said dynode plates adjacent to each other do not cause said engaging members to overlap each other in a stacking direction of said dynode plates.

2. A multiplier according to claim 1, wherein said engaging member is constituted by a pair of guide pieces for guiding said corresponding connecting pin.

3. A multiplier according to claim 1, wherein a portion near an end portion of said connecting pin, which is connected to said engaging member, is formed of a metal material having a rigidity lower than that of a remaining portion of said connecting pin.

4. A multiplier according to claim 1, further comprising a base member having said dynode unit mounted on a front surface thereof through said anode plate, said base member having a region on said front surface opposing said anode plate and through holes for guiding said connecting pins from a rear surface of said base member at a periphery of said region.

5. A multiplier according to claim 4, wherein said connecting pin guided to said through hole in said base member is fixed to said base member at a predetermined portion by a fixing member consisting of a glass material, said fixing member having a shape tapered from said surface of said base member along said connecting pin.

6. A multiplier according to claim 4, wherein an arrangement position of said engaging member provided to said side surface of a predetermined dynode plate of said dynode unit and an arrangement position of a predetermined through hole, formed in said base member, for guiding said corresponding connecting pin for applying a predetermined voltage to said predetermined dynode plate are matched with each other in the stacking direction of said dynode plates.

7. A multiplier according to claim 1, wherein said anode plate has an engaging member applied to be engaged with a corresponding one of said connecting pins at a predetermined portion of a side surface thereof in parallel to the incident direction of said electrons.

8. A multiplier according to claim 1, wherein said anode plate comprises a plurality of anodes and electron passage holes through which secondary electrons pass in correspondence with positions where the secondary electrons emitted from a last-stage dynode plate of said dynode unit reach, and further comprising an inverting dynode plate for inverting orbits of the secondary electrons passing through said anode plate toward said anodes, arranged parallel to said last-stage dynode plate at a position where said anode plate is sandwiched between said inverting dynode plate and said last-stage dynode plate of said dynode unit.

9. A multiplier according to claim 8, wherein a diameter of an electron exit port of said electron passage hole formed in said anode plate is larger than that of an electron incident port of said electron passage hole.

10. A multiplier according to claim 8, wherein said inverting dynode plate has an engaging member adapted to be engaged with a corresponding one of said connecting pins at a predetermined portion of a side surface thereof in parallel to the incident direction of said electrons.

11. A multiplier according to claim 8, wherein said inverting dynode plate has, at positions opposing said anode plate, a plurality of through holes for injecting a metal vapor to form at least a secondary electron emitting layer on a surface of each dynode of said dynode unit.

12. A multiplier according to claim 8, further comprising a shield electrode plate for inverting the orbits of the secondary electrons passing through said anode plate toward said anodes, arranged parallel to said anode plate at a position where said inverting dynode plate is sandwiched between said anode plate and said shield electrode plate, said shield electrode plate having a plurality of through holes for injecting a metal vapor to form at least a secondary electron emitting layer on a surface of each dynode of said dynode unit.

13. A multiplier according to claim 12, wherein said shield electrode plate has an engaging member adapted to be engaged with a corresponding one of said connecting pins at a predetermined portion of a side surface thereof in parallel to the incident direction of said electrons.

14. A multiplier according to claim 1, wherein said dynode plate is constituted by at least two plates, each having at least one opening for forming said dynode, and integrally formed by welding such that said openings of said two plates are matched with each other to function as said dynodes when said two plates are overlapped.

15. A multiplier according to claim 14, wherein each said two plates for constituting said dynode plate has at least one projecting piece for welding said corresponding two plates.

16. A photomultiplier comprising:

a photocathode;

an anode plate for supporting at least one anode;

a dynode unit provided between said photocathode and said anode plate and formed by stacking a plurality of stages of dynode plates in an incident direction of photoelectrons emitted from said photocathode such that a last-stage dynode plate of said dynode unit opposes in parallel said anode plate, spaced apart from each other through insulating members at predetermined intervals, each of said dynode plates adapted to support at least one dynode for cascade-multiplying said photoelectrons; and a plurality of connecting pins, each adapted to be engaged with one of said dynode plates for applying a desired potential thereto, wherein each of said dynode plates having an engaging member adapted to be engaged with a corresponding one of said connecting pins at a predetermined portion of a side surface thereof in parallel to the incident direction of said photoelectrons, and said predetermined portions of said dynode plate adjacent to each other do not cause said engaging members to overlap each other in a stacking direction of said dynode plates.

17. A photomultiplier according to claim 16, wherein said engaging member is constituted by a pair of guide pieces for guiding said corresponding connecting pin.

18. A photomultiplier according to claim 16, wherein a portion near an end portion of said connecting pin, which is connected to said engaging member, is formed of a metal material having a rigidity lower than that of a remaining portion of said connecting pin.

19. A photomultiplier according to claim 16, further comprising a base member having said dynode unit mounted on a front surface thereof through said anode plate, said base member having a region on said front surface opposing said anode plate and through holes for guiding said connecting pins from a rear surface of said base member at a periphery of said region.

20. A photomultiplier according to claim 19, wherein said connecting pin guided to said through hole in said base member is fixed to said base member at a predetermined portion by a fixing member consisting of a glass material, said fixing member having a shape tapered from said surface of said base member along said connecting pin.

21. A photomultiplier according to claim 16, wherein an arrangement position of said engaging member provided to said side surface of a predetermined dynode plate of said dynode unit and an arrangement position of a predetermined through hole, formed in said base member, for guiding said corresponding connecting pin for applying a predetermined voltage to said predetermined dynode plate are matched with each other in the stacking direction of said dynode plates.

22. A photomultiplier according to claim 16, further comprising a focusing electrode plate for supporting at least one focusing electrode between said photocathode and said dynode unit, said focusing electrode plate being fixed on an electron incident side of said dynode unit through insulating members.

23. A photomultiplier according to claim 22, wherein said focusing electrode plate has an engaging member applied to be engaged with a corresponding one of said connecting pins at a predetermined portion of a side surface thereof in parallel to the incident direction of said photoelectrons.

24. A photomultiplier according to claim 22, wherein said focusing electrode plate has a contact terminal brought into contact with said photocathode to equalize potentials of said focusing electrode and said photocathode, said contact terminal being integrally formed with said focusing electrode plate.

25. A photomultiplier according to claim 16, wherein said anode plate has an engaging member applied to be engaged with a corresponding one of said connecting pins at a predetermined portion of a side surface thereof in parallel to the incident direction of said photoelectrons.

26. A photomultiplier according to claim 16, wherein said anode plate comprises a plurality of anodes and electron passage holes through which secondary electrons pass in correspondence with positions where the secondary electrons emitted from a last-stage dynode plate of said dynode unit reach, and further comprising an inverting dynode plate for inverting orbits of the secondary electrons passing through said node plate toward said anodes, arranged parallel to said last-stage dynode plate at a position where said anode plate is sandwiched between said inverting dynode plate and said last-stage dynode plate of said dynode unit.

27. A photomultiplier according to claim 26, wherein a diameter of an electron exit port of said electron passage hole formed in said anode plate is larger than that of an electron incident port.

28. A photomultiplier according to claim 26, wherein said inverting dynode plate has an engaging member adapted to be engaged with a corresponding one of said connecting pins at a predetermined portion of a side surface thereof in parallel to the incident direction of said photoelectrons.

29. A photomultiplier according to claim 26, wherein said inverting dynode plate has, at positions opposing said anode plate, a plurality of through holes for injecting a metal vapor to form at least a secondary electron emitting layer on a surface of each dynode of said dynode unit.

30. A photomultiplier according to claim 26, further comprising a shield electrode plate for inverting the orbits of the secondary electrons passing through said anode plate toward said anodes, arranged parallel to said anode plate at a position where said inverting dynode plate is sandwiched between said anode plate and said shield electrode plate, said shield electrode plate having a plurality of through holes for injecting a metal vapor to form at least a secondary electron emitting layer on a surface of each dynode of said dynode unit.

31. A photomultiplier according to claim 30, wherein said shield electrode plate has an engaging member adapted to be engaged with a corresponding one of said connecting pins at a predetermined portion of a side surface thereof in parallel to the incident direction of said photoelectrons.

32. A photomultiplier according to claim 16, wherein said dynode plate is constituted by at least two plates, each having at least one opening for forming said dynode and integrally formed by welding such that said openings of said two plates are matched with each other to function as said dynodes when said two plates are overlapped.

33. A photomultiplier according to claim 32, wherein each said two plates for constituting said dynode plate has at least one projecting piece for welding said corresponding two plates.

34. A photomultiplier comprising:

a housing for fabricating a vacuum container, having a light receiving plate;

a photocathode deposited on a surface of said light receiving plate, said photocathode provided in said housing;

a dynode unit constituted by stacking a plurality of stages of dynode plates in an incident direction of photoelectrons emitted from said photocathode, each of said dynode plates adapted to support at least one dynode for receiving and cascade-multiplying said photoelectrons;

a plurality of connecting pins, each adapted to be connected to one of said dynode plates for applying a desired potential thereto;

a base member integrally formed with said housing to form said vacuum container and having said dynode unit mounted thereon and through holes for guiding said plurality of connecting pins; and an anode plate for supporting at least one anode provided between said dynode unit and said base member, wherein each of said dynode plates which constitutes said dynode unit has an engaging member adapted to be engaged with a corresponding one of said connecting pins at a predetermined portion of a side surface thereof in parallel to the incident direction of said photoelectrons, and said predetermined portions of said dynode plates adjacent to each other do not cause said engaging members to overlap each other in a stacking direction of said dynode plates.

35. A photomultiplier according to claim 34, wherein said engaging member is constituted by a pair of guide pieces for guiding said corresponding connecting pin.

36. A photomultiplier according to claim 34, wherein a portion near an end portion of said connecting pin, which is connected to said engaging member, is formed of a metal material having a rigidity lower than that of a remaining portion of said connecting pin.

37. A photomultiplier according to claim 34, wherein said base member has said dynode unit mounted on a front surface thereof through said anode plate, said base member having a region on said front surface opposing said anode plate and through holes for guiding said connecting pins from a rear surface of said base member at a periphery of said region.

38. A photomultiplier according to claim 37, wherein said connecting pin guided to said through hole in said base member is fixed to said base member at a predetermined portion by a fixing member consisting of a glass material, said fixing member having a shape tapered from said surface of said base member along said connecting pin.

39. A photomultiplier according to claim 37, wherein an arrangement position of said engaging member provided to said side surface of a predetermined dynode plate of said dynode unit and an arrangement position of a predetermined through hole, formed in said base member, for guiding said corresponding connecting pin for applying a predetermined voltage to said predetermined dynode plate are matched with each other in the stacking direction of said dynode plates.

40. A photomultiplier according to claim 34, further comprising a focusing electrode plate for supporting at least one focusing electrode between said photocathode and said dynode unit, said focusing electrode plate being fixed on an electron incident side of said dynode unit through insulating members.

41. A photomultiplier according to claim 40, wherein said focusing electrode plate has an engaging member adapted to be engaged with a corresponding one of said connecting pins at a predetermined portion of a side surface thereof in parallel to the incident direction of said photoelectrons.

42. A photomultiplier according to claim 40, wherein said focusing electrode plate has holding springs brought into contact with an inner wall of said housing to hold an arrangement position of said dynode unit at a side surface thereof in parallel direction of said photoelectrons, said holding spring being integrally formed with said focusing electrode plate.

43. A photomultiplier according to claim 40, wherein said focusing electrode plate has a contact terminal brought into contact with said photocathode to equalize potentials of said focusing electrode and said photocathode, said contact terminal being integrally formed with said focusing electrode plate.

44. A photomultiplier according to claim 34, wherein said anode plate has an engaging member adapted to be engaged with a corresponding one of said connecting pins at a predetermined portion of a side surface thereof in parallel to the incident direction of said photoelectrons.

45. A photomultiplier according to claim 34, wherein said anode plate comprises a plurality of anodes and electron passage holes through which secondary electrons pass in correspondence with positions where the secondary electrons emitted from a last-stage dynode plate of said dynode unit reach, and further comprising an inverting dynode plate for inverting orbits of the secondary electrons passing through said node plate toward said anodes, arranged parallel to said last-stage dynode plate at a position where said anode plate is sandwiched between said inverting dynode plate and said last-stage dynode plate of said dynode unit.

46. A photomultiplier according to claim 45, wherein a diameter of an electron exit port of said electron passage hole formed in said anode plate is larger than that of an electron incident port.

47. A photomultiplier according to claim 45, wherein said inverting dynode plate has an engaging member adapted to be engaged with a corresponding one of said connecting pins at a predetermined portion of a side surface thereof in parallel to the incident direction of said photoelectrons.

48. A photomultiplier according to claim 45, wherein said inverting dynode plate has, at positions opposing said anode plate, a plurality of through holes for injecting a metal vapor to form at least a secondary electron emitting layer on a surface of each dynode of said dynode unit.

49. A photomultiplier according to claim 45, further comprising a shield electrode plate for inverting the orbits of the secondary electrons passing through said anode plate toward said anodes, arranged parallel to said anode plate at a position where said inverting dynode plate is sandwiched between said anode plate and said shield electrode plate, said shield electrode plate having a plurality of through holes for injecting a metal vapor to form at least a secondary electron emitting layer on a surface of each dynode of said dynode unit.

50. A photomultiplier according to claim 34, wherein said dynode plate is constituted by at least two plates, each having at least one opening for forming said dynode, and integrally formed by welding such that said openings are matched with each other to function as said dynodes when said two plates are overlapped.

51. A photomultiplier according to claim 50, wherein each said two plates for constituting said dynode plate has at least one projecting pieces for welding corresponding said two plates.

* * * * *